United States Patent [19]

Brown

[11] Patent Number: 4,559,800

[45] Date of Patent: Dec. 24, 1985

[54] PREHEAT START-UP ARRANGEMENT FOR STAMPING AND FORMING PRESSES

[75] Inventor: Omar L. Brown, Dayton, Ohio

[73] Assignee: Dayton Reliable Tool & Mfg. Co., Dayton, Ohio

[21] Appl. No.: 621,646

[22] Filed: Jun. 18, 1984

[51] Int. Cl.[4] ..... B21D 37/16

[52] U.S. Cl. ..... 72/342; 72/455; 83/170; 100/214; 219/149

[58] Field of Search ..... 72/342, 455; 100/282, 100/214, 35; 82/DIG. 1; 83/170; 219/149

[56] References Cited

U.S. PATENT DOCUMENTS 3,350,913 11/1967 Bergholdt et al. ..... 72/342
3,926,029 12/1975 Abson et al. ..... 72/342
4,103,588 8/1978 Schmid ..... 82/DIG. 1
4,375,785 3/1983 Schoch et al. ..... 100/35
4,444,039 4/1984 Asari et al. ..... 72/342

*Primary Examiner*—Daniel C. Crane
*Assistant Examiner*—David B. Jones
*Attorney, Agent, or Firm*—Biebel, French & Nauman

[57] ABSTRACT

The connecting arms or connection elements of a metal-working press, such as a metal forming or stamping press, are provided with flat electrical resistance heating pads attached directly to the web section of the connections for applying heat to the connections for preheating the connections to a desired temperature, prior to press start up, to stabilize the dimensions thereof.

8 Claims, 5 Drawing Figures

PREHEAT START-UP ARRANGEMENT FOR STAMPING AND FORMING PRESSES

BACKGROUND OF THE INVENTION

This invention relates to a mechanical press of the type used for metal stamping and forming, and more particularly to a preheat start-up arrangement and apparatus for temperature stabilization of the slide connecting rods or connection elements.

Conventional mechanical presses for metal forming or stamping include a bed which is mounted on a platform or on the floor of the shop. The bed supports a vertically spaced crown supported on a pair of uprights or vertical frame members. The crown contains a drive assembly, which typically includes a crankshaft having one or more crank means in the form of eccentrics, and connecting arms or "connections", supported at the eccentrics at their upper ends. A slide is mounted in guideways on the upright frame members for vertical reciprocating motion. The connections have lower ends which engage and support the slide at a wristpin and a threaded screw, and provide for vertical stamping movement of the slide with the rotation of the crankshaft.

A die set as used with the press has one-half mounted on the lower surface of the slide, and another half mounted on a bolster which, in turn, is mounted to the bed of the press. In precision die sets, it is important that the closing of the dies making up the set be accurately controlled, such as to less than a thousandth of an inch. In order to obtain such control to provide the proper stroke, to prevent overstroking, and to prevent or avoid tooling damage, it is necessary to bring critical parts of the press up to a predetermined operating temperature prior to press operation. Since the connections form the only link between the slide supporting one part of the die set on the one hand and the crown on the other hand, it has been found desirable to preheat the connections, for the purpose of controlling growth or lengthening in subsequent operation, and thereby substantially eliminating subsequent growth by bringing the connections up to an operating temperature prior to press operation. Further, such preheating permits the setting up of the dies to minimize the load which will be taken by the stop blocks which define the maximum die stroke, and further permits the proper setting up of the stop blocks themselves.

In the past, a heated oil circulating supply, separate from a main source of lubricating oil, has been utilized for the purpose of preheating the connections. This has entailed providing passageways through the drive shaft and the eccentrics into the connections for the circulation of heating oil therethrough, and the use of a separate heater and pump in the circuit for pumping the heated oil through the shaft, eccentrics, and connections. However, this has proven to be not only expensive, but also time consuming in that about one hour to one and one-half hours was found to be required to bring the connections up from an ambient temperature of 68° F. to an operating temperature of from about 125° F. to 140° F.

SUMMARY OF THE INVENTION

This invention is directed to arrangements for preheating the connecting arms or connections of a metal working press, which utilize electrical heater pads or the like which are attached directly to the surfaces of the connections.

Heat can be applied to the connections directly by means of attached electrical heater pads which have relatively high thermal watt density, and which are characterized by a relatively insignificant weight as compared to the weight of the connections, for applying heat directly thereto in an efficient manner, substantially reducing the length of time required to bring the connections up to operating temperature, prior to press start up. In a typical press, the connection includes a web-shaped section which joins a wrist pin boss and a journal boss, defining a pair of oppositely deposed relatively flat surfaces. Flat heater pads, such as silicone rubber heaters having an internal resistance elements of wire or foil embedded therein, are applied such as by bonding directly to the flat sides of the web portion. The temperature throughout the entire connection, including the journal and the connection wristpin, and connection screw, may be heated by thermal conduction from one or more of such applied heating pads.

The apparatus further includes arrangements by means of which power, from an outside source of electrical power, may be applied to the heater pads. In one of the preferred embodiments, heat is applied to the pads while the connections are at their top dead center position and prior to start-up. This arrangement includes a pair of movable electrical contacts, for each of the connections, which are selectively movable into engagement with corresponding solid contacts positioned on the crank bushing boss or the bearing shell. The movement of the contacts from a retracted or inoperative position to an extended or operative position may be controlled by an actuator, such as a double-acting air cylinder or the like. This particular embodiment has the advantage of reducing the amount of exposed wiring between the slide and the frame, reducing the overall number of junction boxes required, and eliminating hard wire connections which are subject to flexure during the operation of the press.

In a second preferred embodiment the electrical heater pads may be wired to junction boxes carried directly on the web portions of the connection, between the pads, which junction boxes are in turn provided with power from an external source of power through a wiring harness, which includes protected wires extending from suitable openings in the slide to the junction boxes and terminating at additional junction boxes carried on the slide itself, with power to such additional junction boxes being provided from electrical fittings or junctions, through flexible electrical wiring conduits, from the frame. Similarly, where desired, thermocouple leads may be positioned and supported in generally parallel relation to the power input leads through the respective junction boxes. With this arrangement it is possible to continue to apply heat to the connections after press start up, and prior to full temperature stabilization. Thus, in some installations, there may be a period of time before all of the parts become temperature stabilized. Thus, during this period of time, the connections may actually lose part of the heat which had been applied prior to start-up, and this loss can be made up by the wiring arrangement which is disclosed in the second preferred embodiment.

Accordingly, it is an important object of this invention to provide electrical heater apparatus for the direct application of heat to the connecting arms or connections of a metalworking press by means of electrical heat pads applied directly to the connections.

A still further object of the invention is the provision of a press connection which may be preheated by means of electrical pads secured against or directly to the web portion of a connection.

A more particular object of the invention is the provision of a press connection and electrical heater pad combination, together with an electrical contact arrangement for preheating the press connections prior to start up while the slide in a top dead center position. The electrical heater contact arrangement includes provision for arcless contact, when the connection is not moving.

A further object of the invention is the provision of heated connections for a metalworking press, in which elastomer encapsulated pad-type heaters are applied directly to an exposed surface of the web of the connecting links or the connectors.

These and other objects and advantages of the invention will be apparent from the following description, the accompanying drawings, and the appended claims.

DESCRIPTION OF PREFERRED EMBODIMENTS

Figure 1:
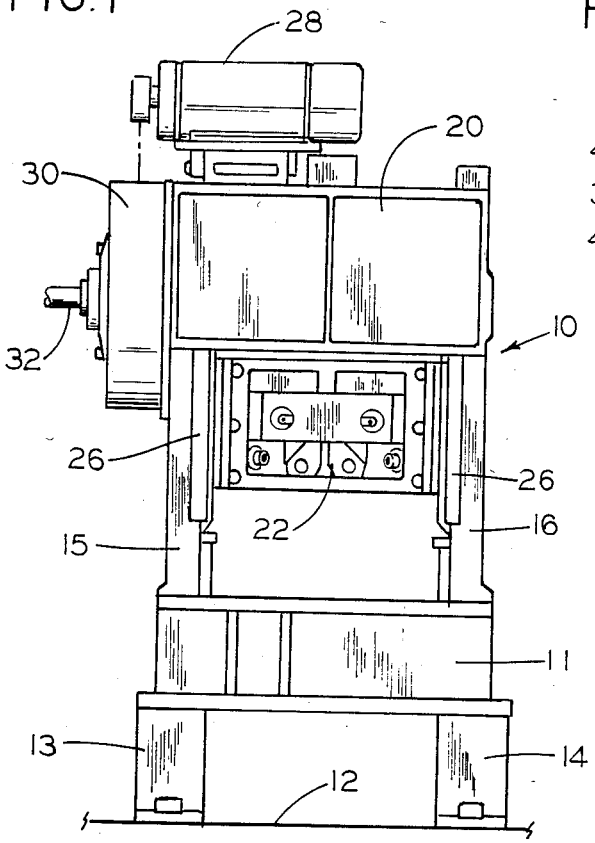
FIG. 1 is a front elevational view of a metalworking press to which the invention is applied.

Referring to the drawings which represent preferred embodiments of the invention, a stamping and forming press to which the invention is applied is illustrated generally at 10 in FIG. 1. The press 10 is formed with a bed 11 which is mounted or supported on the floor 12 by a pair of legs 13 and 14. The bed rigidly supports a pair of spaced-apart frame uprights 15 and 16 in upstanding relation from the bed. The upper end of the frame 15 and 16 support a crown 20. The crown 20 incorporates the drive mechanism for causing the reciprocation of a slide 22. The slide 22 is mounted in suitable guide ways or gibs 26 on the frame uprights, for limited reciprocating movement as driven by the mechanism within the crown 20.

The crown 20, on its upper surface, supports a variable speed main drive 28 which is suitably belted to a flywheel and clutch-brake 30. The clutch-brake 30 rotates a transverse crankshaft 32, so that when the motor 28 is energized, the rotary motion of the flywheel is transmitted to the crankshaft 32.

Crankshaft throw means or cranks in the form of eccentrics 35 are formed on the crankshaft 32 for imparting reciprocating motion to the slide 22 through connections 40. The connections 40 include a central web-like portion 41 formed with an outwardly-opening journal cap 42 thereon which supports an outer journal cap or shell 44 and an internal sleeve bearing 45 in surrounding relation to an eccentric 35. The lower end of the connecting web portion 41 is pivotally joined to a connection screw 48 by a connection pin or wrist pin 49, so that the rotary-oscillatory motion is transmitted to the slide 22 by means of the waist pin 49 and the connection screw 48.

Tooling in the form of upper and lower die set halves (not shown) are mounted in the press. The upper die half is carried on a lower surface of the slide 22 and the lower half generally carried on a bolster, in turn mounted on the bed 11. As the press operates, friction heat is generated at the interface between the moving parts, and thus, over a period of time, the connection 40 will be subject to a rise in temperature from ambient of about 68° F. to an operating temperature of from 125° F. to 140° F. for example.

The invention provides means for bringing the connections 40 up to operating temperature prior to press start up, and includes heater means which are directly attached to the connection, in the form of pad-type heaters 50. The heaters 50 may be formed of a silicone rubber which encapsulates an electrical resistance element, such as wire or foil.

Heaters may thus be operated directly from a source of regulated or reduced AC potential, such as 70 to 80 volts, 60 cycle AC, with a maximum watt density in the order of 10–20 watts per square inch, such as manufactured, for example, by Watlow Corporation, 12001 Lakeland Road, St. Louis, Mo. The reduced or lower voltage from 70 to 80 volts, for example, is preferred, to prevent arcing at the contacts.

Figure 3:
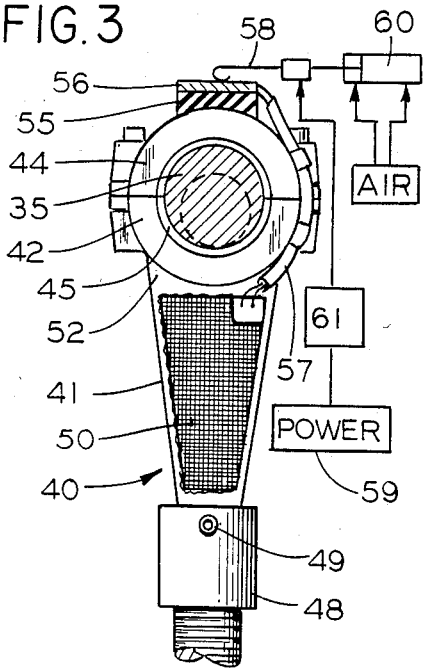
FIG. 3 is a fragmentary side elevation, with the drive shaft shown in section, of one the connections of the press, and showing in one embodiment an arrangement for applying power to the heater pads.
Figure 2:
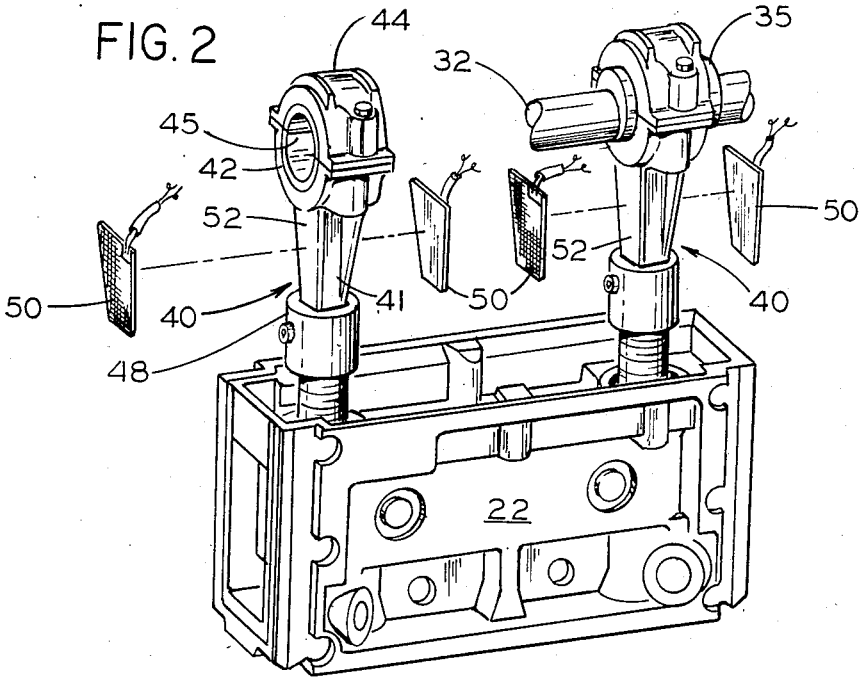
FIG. 2 is an exploded perspective view of the connection and slide arrangement showing a fragment of the drive shaft, and showing the heaters in exploded relation to the sides of the connections.

The heaters 50 may thus be formed in the form of heating pads which have flat attaching surfaces, and can be configured into any desired shapes for the purpose of conforming to the available shape of the connection. For example, the heaters 50 may be formed with a trapezoidal shape, as shown in FIGS. 2 and 3, for direct attachment to the exposed flat surfaces 52 of the web portion 41, by any suitable adhesive, so that a pair of the heaters 50 become bonded to each of the flat opposed web surfaces 52, in opposed relation. Accordingly, it is preferred to use two heaters for each connection, in opposed relation to each other, on opposite sides of the connection. The heaters 50 add negligible weight to the connection and therefore do not impede the normal operation of the press.

As previously mentioned, the invention provides means for applying electric energy to the heaters at a time prior to press start-up. One of these arrangements is illustrated in FIG. 3, in which provision is made for applying electric energy to the heaters at the top dead center position of the slide, prior to press start-up, with an arcless movable contact arrangement. For this purpose, the upper bearing cap 44 carries a bonded in place insulator block 55. The block 55 in turn supports a pair of laterally spaced contacts 56, only one of which contacts is shown in FIG. 3. The contact pairs 56 are joined with the wire pairs 57 and extend in parallel to the heater pads 50 positioned at either side of the connection 40 on the surfaces 52.

Reciprocal or movable contact means includes a pair of side-by-side spring contacts 58 which are connected to a suitable source 59 of power and are movable into and out of operative contact position by motor means in the form of a double-acting air cylinder 60. An electrical interlock circuit 61 may be provided to allow the power to be turned on to the spring contacts 56 only when the contacts 56 are closed in contact with the electrical contacts 55, so as to prevent the possibility of arcing. The air cylinder 60 is a preferred means for moving the spring contacts 58 into and out of engagement with the solid contacts 56, since in the event of failure of the air supply, the piston will remain in the operative position shown, and will not retract with the power on and thereby cause an arc.

In the operation of the embodiment of FIG. 3, the press slide is moved to its upper position carrying the connection to its top dead center position, as shown. Air is applied to the cylinder 60 to cause it to extend carrying the contacts 58 into engagement with the solid contacts 56. The interlock 61 senses contact and the power supply thereto is turned on.

Suitable temperature controls, as known in the art, may be employed to determine when the connections 40 have obtained the desired operating temperature. For example, a conventional thermocouple-controlled power source may be used which incorporates a thermocouple bonded to or embedded in the connection, to interrupt power at the desired temperature. Alternatively, an integrated power supply may be provided such as in accordance with the teachings of U.S. Pat. No. 4,086,466 issued Scharlack on Apr. 25, 1978, by means of which the resistance of the heater element itself is monitored as an indication of temperature.

Figure 4:
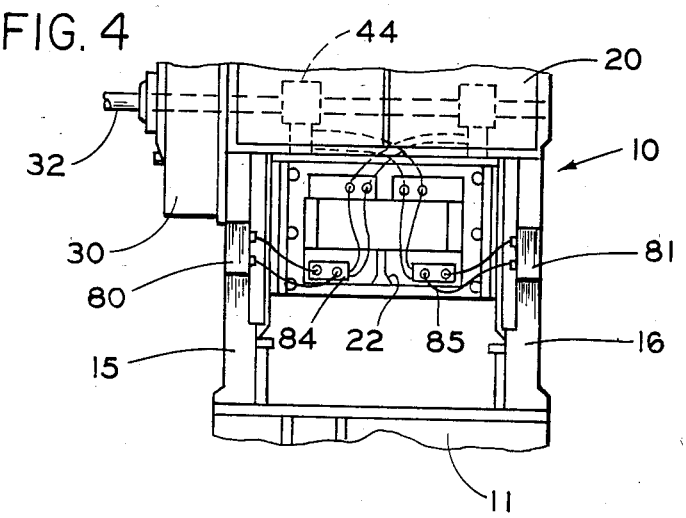
FIG. 4, is a fragmentary elevational view of the press showing a modified electrical feed arrangement.
Figure 5:
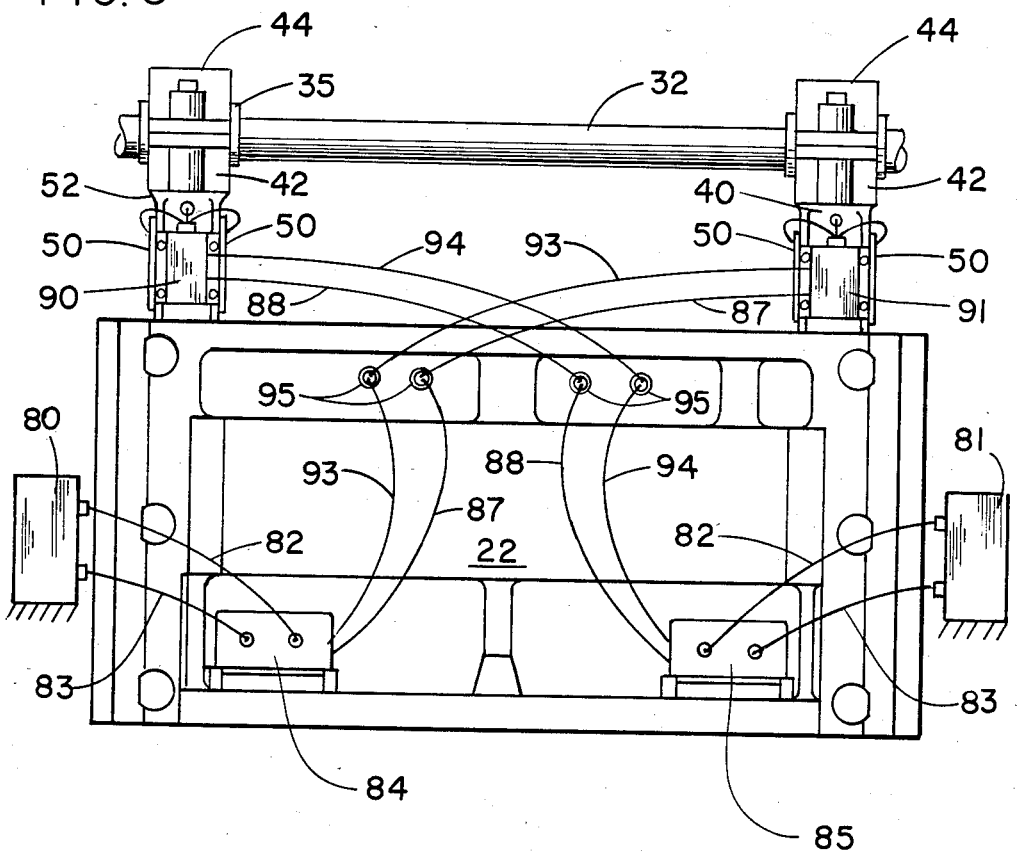
FIG. 5 is an enlarged elevational view of the slide showing details of the electrical feed of FIG. 4.

In some instances it may be preferred to provide power to the heater pads 50 through a "hard wired arrangement", and a wiring setup suitable for this purpose is illustrated in FIGS. 4 and 5. The wiring arrangement as shown in FIGS. 4 and 5 may be preferred in instances where it is desired to continue to apply heat to the connections after press start-up for a period of time until the press temperature is fully stabilized. The master controller will be located at the control console, which will provide the power requirements for the heaters on the connections, such as a relatively low voltage AC power in the order of 70 volts or the like. The temperature controller will also be mounted in the console, and it is therefore necessary to run both the power wires and, where employed, the thermocouple wires, from the frame to the slide and from the slide to the connections.

Referring to FIGS. 4 and 5, the side walls 15 and 16 of frame 10 are provided with power junction boxes 80 and 81, one on each side, which receive power from the main console (not shown). Power leads 82 and thermocouple leads 83 are carried from the junction boxes 80 and 81 to a pair of slide junctions boxes 84 and 85 mounted on the front surface of the slide. The leads 82 and 83 have a sufficient length and are flexible to accommodate the up and down movement of the slide without undue stress on the leads.

Referring first to FIG. 4, it will be seen that the side walls 15 and 16 of the frame 10 are provided with power junction boxes 80 and 81. Power supplied to the boxes 80 and 81 from the console may be carried to the slide 22 through flexible lead-in wires 82, terminating at slide control boxes 84 and 85. FIG. 5 also shows generally parallel-arranged thermocouple leads 83 extending from the boxes 80, 81 to the slide. It is understood that the leads 82 and 83 must be provided with sufficient slack so that they easily accommodate the up and down movement of the slide 22.

Power from the slide boxes 84 and 85 may be provided to each of the respective connections 40 within the heater 20 by means of output leads 87 and 88 which extend through bushed openings formed in the wall of the slide and from there cross over to the opposite connection boxes 90, 91, as shown in FIG. 4. In installations where thermocouple control is required, the thermocouple leads 93 and 94 may also extend from the boxes 84 and 85 in generally parallel relation to the leads 87 and 88, housed, for example, in plastic tubing. Suitable bushings 95 may be provided in the wall of the slide 22 to prevent the leads therethrough from chafing at the junction box, while suitable slack may be formed on the portions of the lead-in wires between the box and the connections to provide for the to-and-fro movement of the connections on the eccentrics. The heater pads 50 have their leads suitably connected to the respective slide junctions 90 and 91 in a relatively permanent manner. The slide junctions may be attached directly to the connections, such as by bolting or the like, on a side adjacent to one of the planar surfaces 52 and adjacent to the heater pads 50, but in non-interferring relation thereto. In this manner, power from the upright junctions 80 and 81 may be applied individually to the heater pad pairs 50 with respect to either of the connections, both prior to and during press operations.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. In a metalworking press having a rotatable crank, a slide for supporting cooperating tooling to open and close for working sheet metal therebetween, and at least one connection element driven by said crank and attached to said slide to open and close said tooling, in which each said connection element has a central web section which forms at least one exposed outer generally flat surface of a given configuration, the improvement comprising:

at least one a silicone rubber heater pad having an electrical resistance element embedded therein and having a shape generally conforming to said configuration of said exposed connection surface, means bonding said pad to said connection element on said exposed surface thereof, and means for applying electric power to said pad for preheating said connection element whereby thermal expansion and lengthening of said element to operating conditions may be accomplished prior to press operation.

2. The press of claim 1 in which said means for applying electric power is effective during operation of said press for maintaining said stabilizing temperature as necessary.

3. Apparatus as defined in claim 1, said heater pad having a mass which is insignificant with respect to the mass of said connection element.

4. The press as defined in claim 1, in which said web section is formed with an opposite piece of said flat surfaces, and a pair of said heater pads bonded respectively to said opposite surfaces of said web section to promote rapid heat transfer to said connection element.

5. In a metalworking press having a rotatable crank means, slide means for supporting cooperating tooling to open and close for working sheet metal therebetween, and at least one connection element driven by said crank means and attached to said slide means to open and close said tooling, the improvement comprising: electric heater means attached to said connection element, means for supplying electrical power to said heater means, electric contact means for applying power to said heater means to pre-heat said connection element to operating temperature, said electrical contact means including a pair of fixed contacts mounted on said connection element, and a pair of movable contacts, and means for moving said movable contacts into engagement with said fixed contacts when said connection element is on top dead center with respect to said crank means, whereby thermal expansion and lengthening of said element to operating conditions may be accomplished rapidly prior to press operation.

6. The apparatus of claim 5 in which said means for moving said contacts includes a two-way air cylinder.

7. In a metalworking press having a bed, a crown supported above said bed, a crank in said crown, a slide mounted between said crown and said frame for vertical movement with respect to said bed, and at least one connection between said crank and said slide for imparting reciprocal movement of said slide with rotary movement of said crank, said connection having an exposed outer surface, the improvement for providing dimensional stability to said connection comprising:

a direct resistance electrical heating pad, means mounting said pad directly to said connection at said exposed outer surface thereof, and power supply means for supplying electric energy to said heating pad for preheating said connection to a predetermined operating temperature prior to press start up.

8. The press of claim 7, including a pair of said heater pads bonded respectively to opposite outer surfaces of said connection.

* * * * *